US012637830B2

(12) United States Patent
Wahlgren et al.

(10) Patent No.: US 12,637,830 B2
(45) Date of Patent: May 26, 2026

(54) BI-DIRECTIONAL SLED

(71) Applicant: Eddy Pump Corporation, El Cajon, CA (US)

(72) Inventors: Daniel Wahlgren, Escondido, CA (US); Roberto Gonzalez, Chula Vista, CA (US); Benjamin Charles Weinrib, Rancho Santa Fe, CA (US)

(73) Assignee: Eddy Pump Corporation, El Cajon, CA (US)

( * ) Notice: Subject to any disclaimer, the term of this patent is extended or adjusted under 35 U.S.C. 154(b) by 583 days.

(21) Appl. No.: 18/109,100

(22) Filed: Feb. 13, 2023

(65) Prior Publication Data

US 2024/0271385 A1 Aug. 15, 2024

(51) Int. Cl.

| | |
|---|---|
| ***E01H 5/04*** | (2006.01) |
| ***E01H 5/06*** | (2006.01) |
| ***E01H 5/08*** | (2006.01) |
| ***E02F 3/40*** | (2006.01) |
| ***E02F 3/413*** | (2006.01) |
| ***E02F 3/815*** | (2006.01) |
| ***E02F 3/92*** | (2006.01) |
| ***E02F 3/94*** | (2006.01) |
| ***E02F 5/02*** | (2006.01) |

(52) U.S. Cl.
CPC ..... *E02F 3/9218* (2013.01); *E02F 3/94* (2013.01); *E02F 5/025* (2013.01)

(58) Field of Classification Search
None
See application file for complete search history.

(56) References Cited

U.S. PATENT DOCUMENTS

| | | | | |
|---|---|---|---|---|
| 3,659,712 | A | 5/1972 | Chaplin | |
| 4,942,682 | A | 7/1990 | McDowell | |
| 5,539,947 | A * | 7/1996 | Kiraly | E04H 4/1636 15/257.1 |
| 5,651,200 | A * | 7/1997 | Walsh | E02F 3/94 37/319 |
| 5,732,487 | A | 3/1998 | Van De Kerckhove | |
| 6,318,005 | B1 * | 11/2001 | Andre | E02F 3/9212 37/317 |

(Continued)

OTHER PUBLICATIONS

International Search Report and Written Opinion issued in corresponding International Application No. PCT/US23/86482.

*Primary Examiner* — Tara Schimpf
*Assistant Examiner* — Alfred H Tsui
(74) *Attorney, Agent, or Firm* — Spencer Fane, LLP

(57) ABSTRACT

A bi-directional sled includes a support structure and a shroud assembly. The shroud assembly is supported to the support structure for pivotal movement about an axis extending through the support structure between a first orientation and a second orientation. The shroud assembly has a shroud with a first edge and a second edge opposite the first edge. With the support structure moving the shroud assembly in the first direction relative to material to be dredged friction between the shroud assembly and material to be dredged pivots the shroud and the first edge into a first orientation to contact material to be dredged. With the support structure moving the shroud assembly in the second direction relative to material to be dredged the shroud and second edge are pivoted into a second orientation to contact material to be dredged.

20 Claims, 18 Drawing Sheets

(56) References Cited

U.S. PATENT DOCUMENTS

| | | | | |
|---|---|---|---|---|
| 2008/0000114 | A1 | 1/2008 | Bentley | |
| 2013/0340298 | A1* | 12/2013 | Phillips | E02F 3/925 37/317 |
| 2016/0194851 | A1 | 7/2016 | De Keizer | |
| 2016/0244942 | A1* | 8/2016 | Horton | E02F 3/8841 |
| 2018/0051440 | A1 | 2/2018 | Leverty et al. | |
| 2021/0062454 | A1 | 3/2021 | Bergeron | |
| 2021/0131058 | A1 | 5/2021 | Bergeron | |
| 2022/0074167 | A1 | 3/2022 | Boor | |

* cited by examiner

BI-DIRECTIONAL SLED

BACKGROUND

Technical Field

The present disclosure generally relates to a bi-directional sled for use with an excavator as part of an overall dredging system. More specifically, the present disclosure relates to a bi-directional sled that loosens and gathers or scoops material when moved by the excavator in a first direction and continues loosening and gathering (or scooping) material when moved by the excavator in a second direction opposite the first direction.

Background Information

Conventional dredging sleds or scoops are rigid structures moved and oriented by a convention excavator or earth moving device. Specifically, dredging sleds are shaped like a shovel and dimensioned such that they can be moved along a floor or bottom surface of a body of water/liquid in a first direction loosening and scooping material. The dredging sled must then be lifted and moved in a second direction opposite the first direction, then lowered down in order to continue the loosening and scooping process.

SUMMARY

One object of the present disclosure is to provide a bi-direction sled with structure that allows the sled to be continuously moved in a first direction and a second direction opposite the first direction while loosening and gathering material along the bottom of a body or water or liquid without being lifted from the floor bottom.

In view of the state of the known technology, one aspect of the present disclosure is to provide a bi-directional sled for a dredging system with a support structure and a shroud structure. The support structure dimensioned and shaped to attach to a distal end of a hydraulic arm of an excavator. The shroud assembly is supported to the support structure for pivotal movement about an axis extending through the support structure between a first orientation and a second orientation. The shroud assembly has a shroud with a first edge and a second edge opposite the first edge. With the support structure moving the shroud assembly in the first direction relative to material to be dredged friction between the shroud assembly and material to be dredged pivots the shroud and the first edge into a first orientation to contact material to be dredged. With the support structure moving the shroud assembly in the second direction relative to material to be dredged the shroud and second edge are pivoted into a second orientation to contact material to be dredged.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
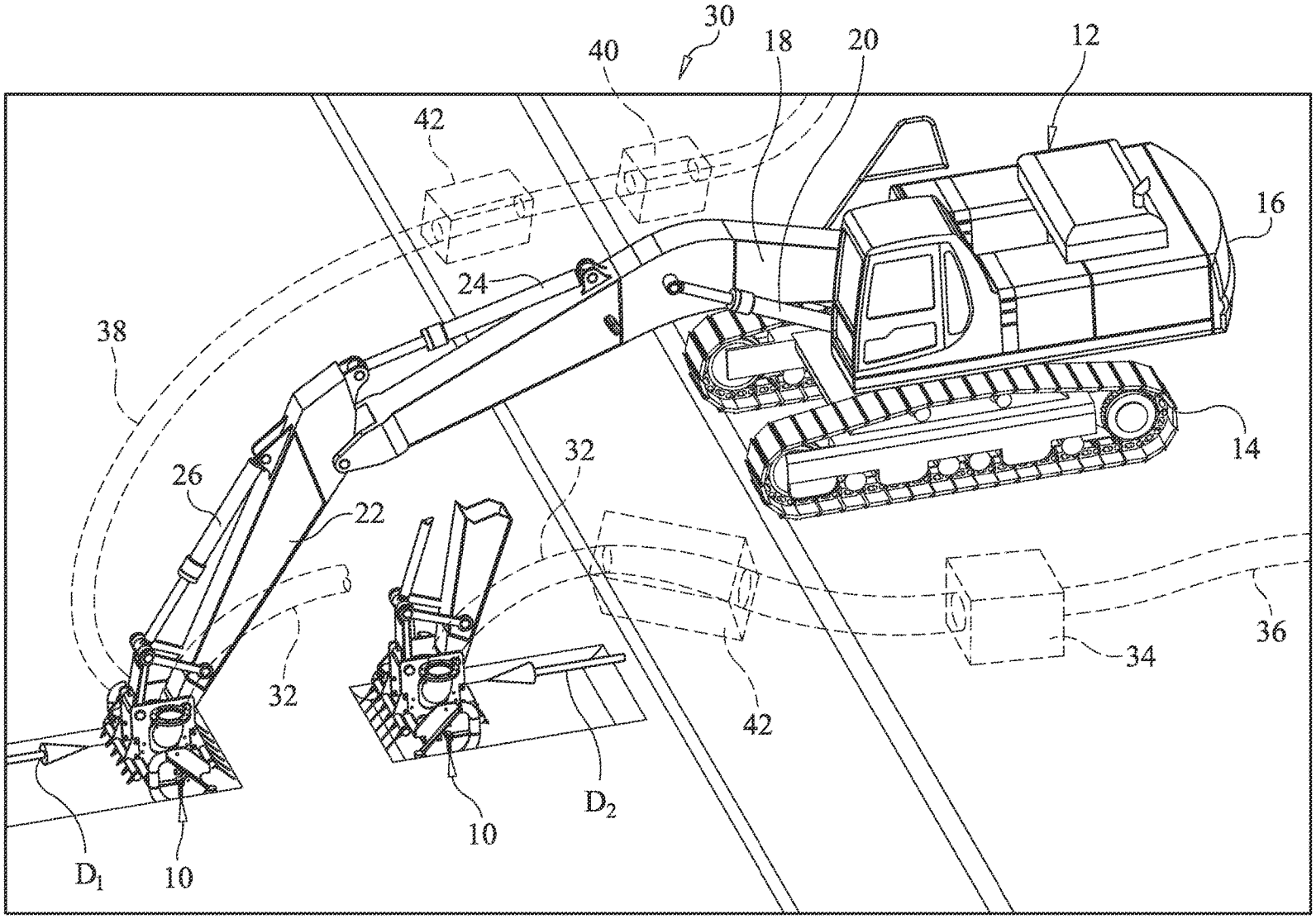
FIG. 1 is a schematic perspective view of a dredging system that includes an excavating machine and a bi-directional sled, with the bi-directional shed being shown with a shroud assembly in a first orientation as it is moved in a first direction and being shown with the shroud assembly in a second orientation as it is moved in a second direction opposite the first direction in accordance with a first embodiment.
Figure 2:
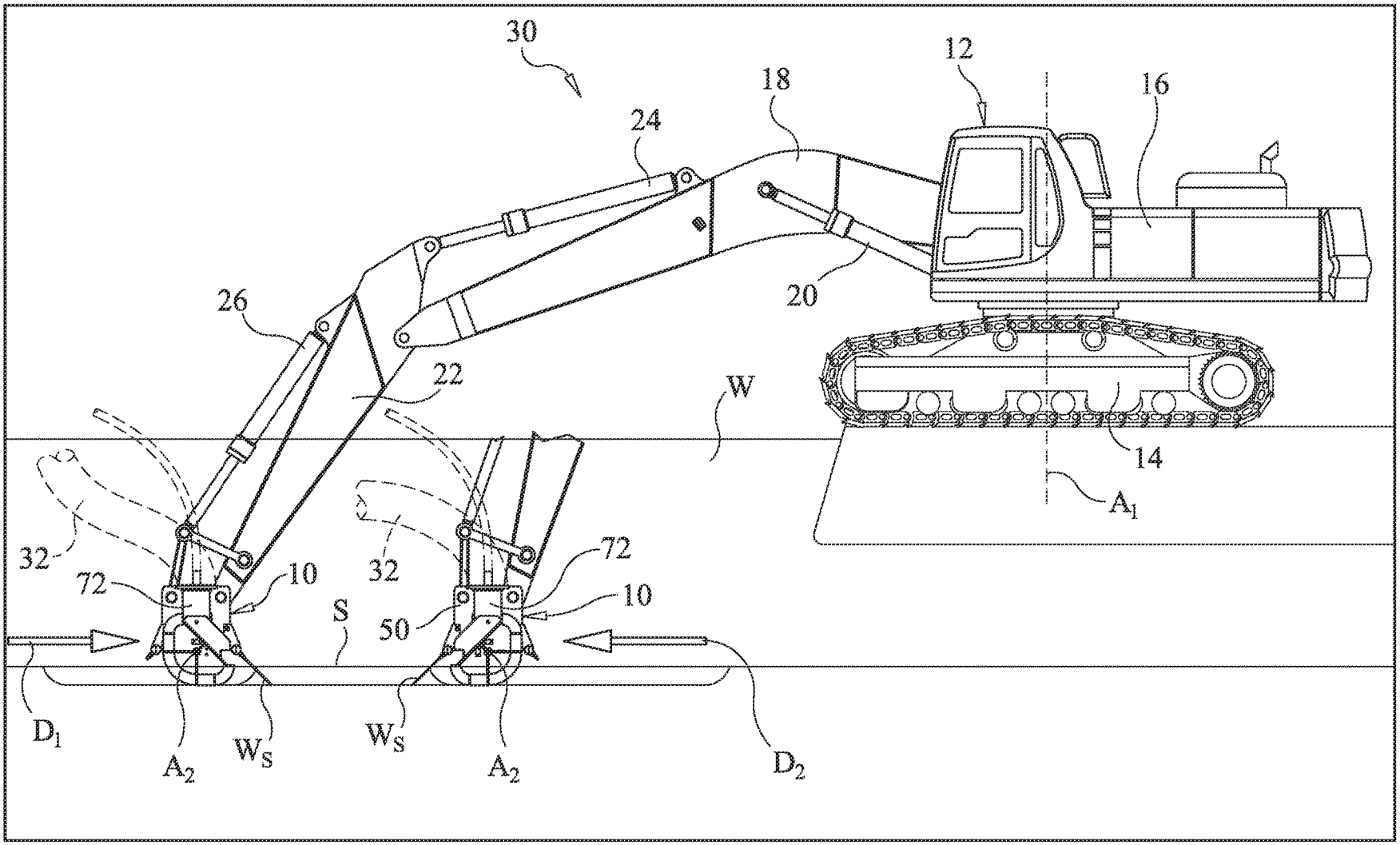
FIG. 2 is a schematic side view of the dredging system showing the shroud assembly of the bi-directional shed in the first orientation as it is moved in the first direction by the excavator machine and showing with the shroud assembly in the second orientation as it is moved in the second direction opposite the first direction in accordance with the first embodiment.
Figure 3:
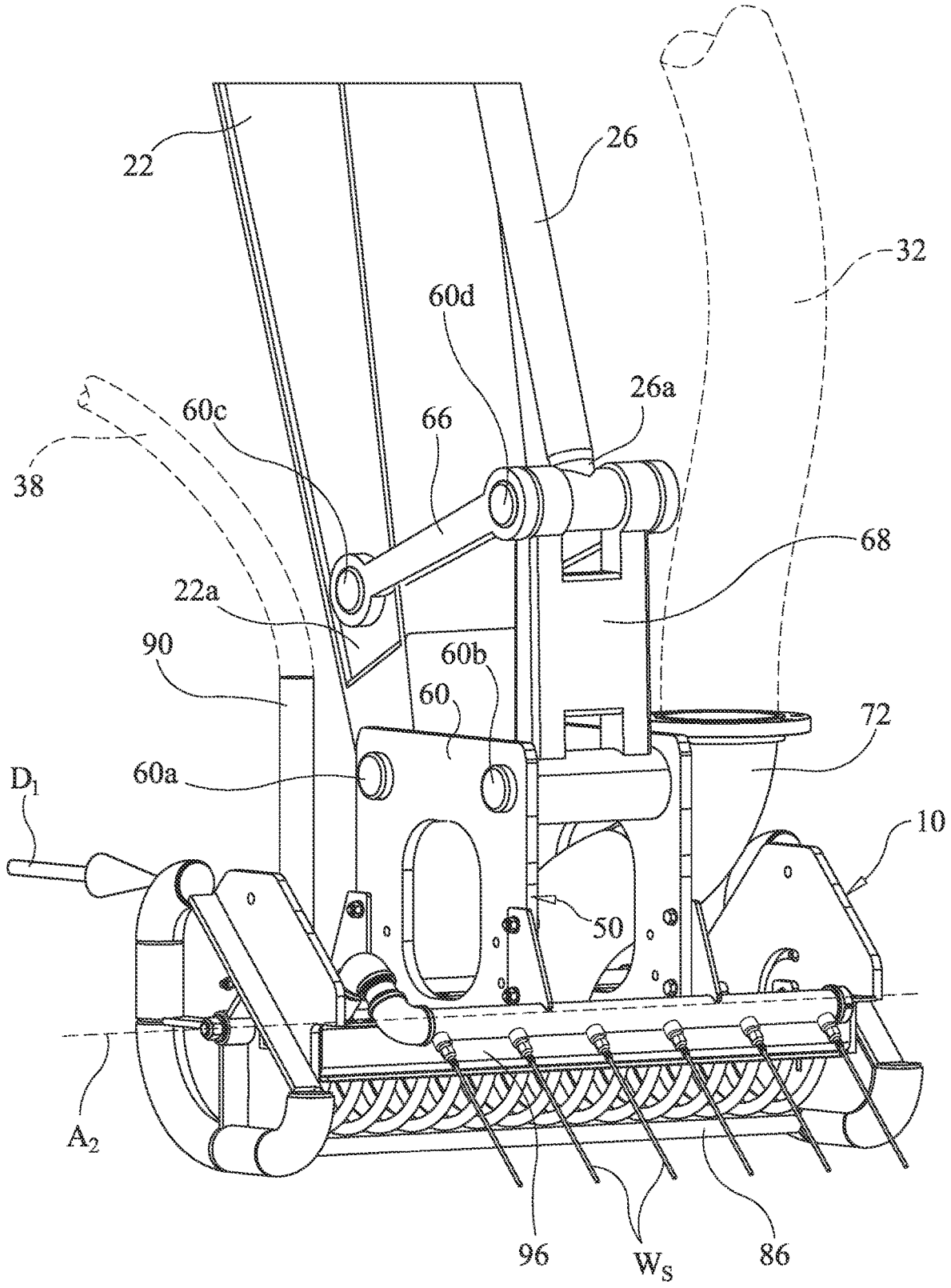
FIG. 3 is a perspective view of the bi-directional sled showing details of a support structure that attaches the bi-directional sled to the excavating machine and includes a shroud panel (an upper shroud panel) and classifier bars attached to the shroud panel, along with details of the shroud assembly which including a shroud (a lower shroud panel) and a pair of runners with the shroud assembly shown in the first orientation in accordance with the first embodiment.
Figure 4:
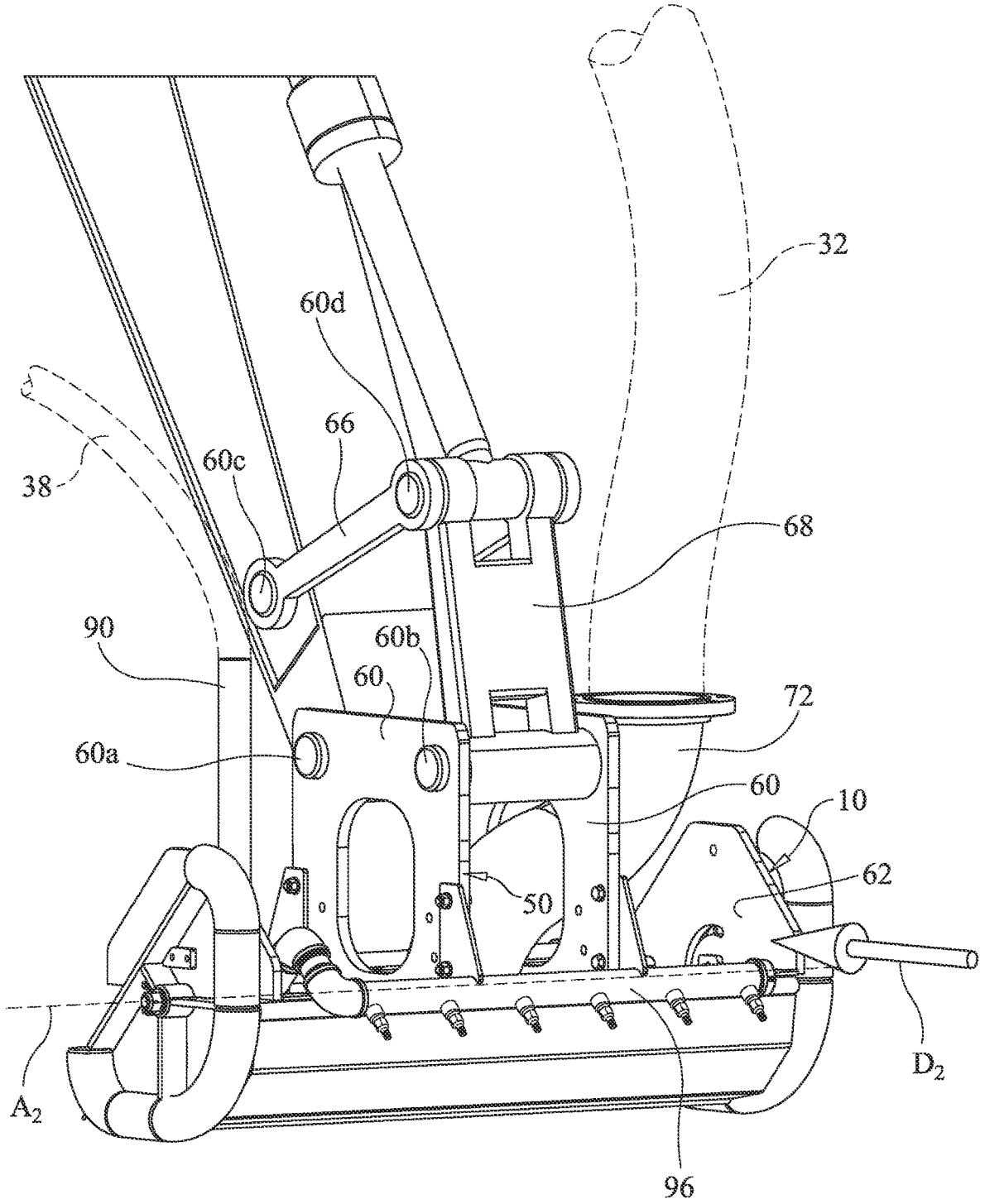
FIG. 4 is another perspective view of the bi-directional sled similar to FIG. 3 showing the shroud assembly shown in the second orientation in accordance with the first embodiment.
Figure 5:
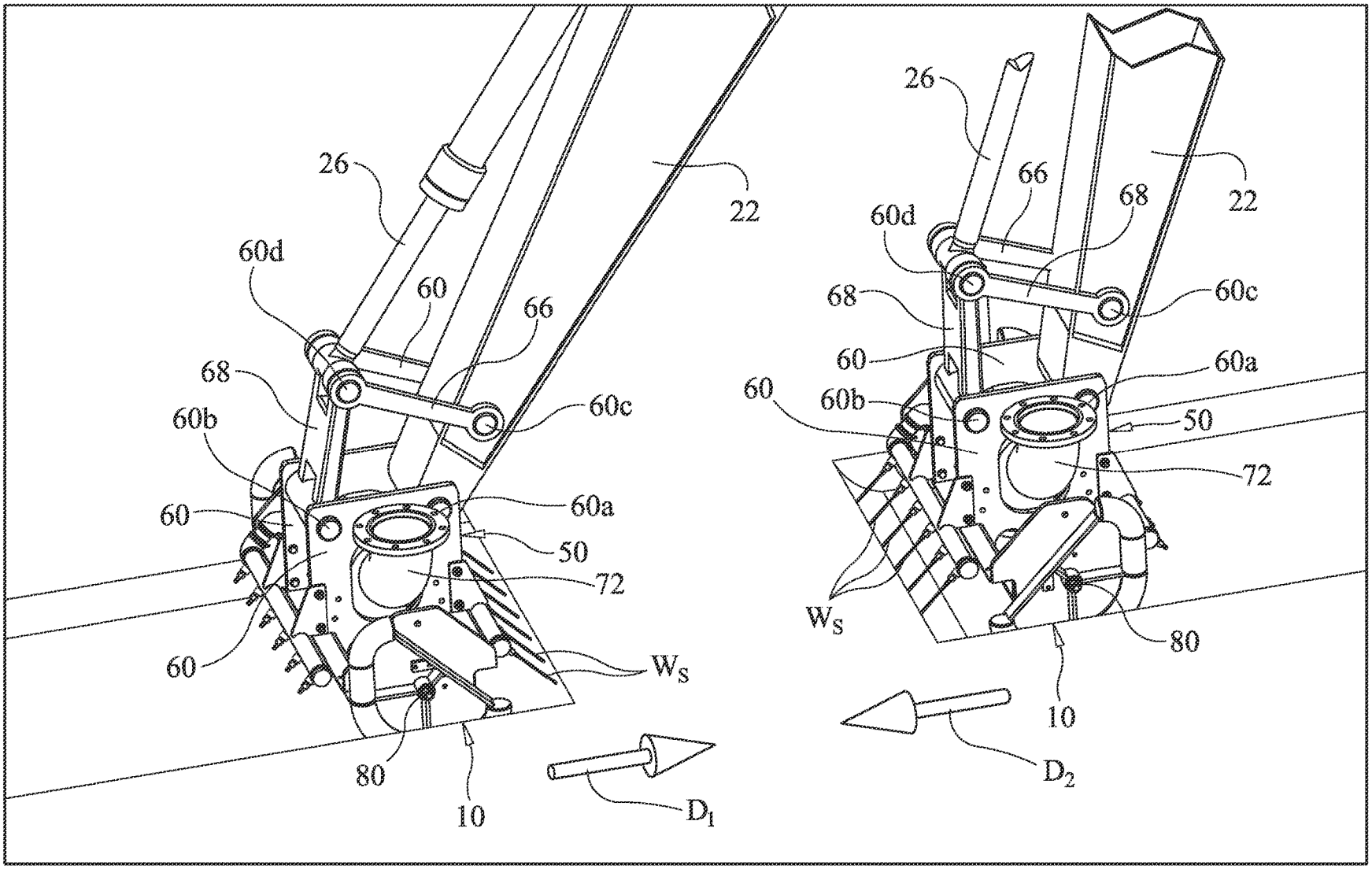
FIG. 5 is a perspective view of a dredging system showing mainly the bi-directional sled on the left side being moved in the first direction with the shroud assembly in the first orientation and on the right side the bi-directional sled being moved in the second direction with the shroud assembly in the second orientation in accordance with the first embodiment.

Referring initially to FIG. 1 and, a bi-directional sled 10 attached to an excavating machine 12 is illustrated in accordance with a first embodiment. The excavating machine 12 is a conventional hydraulically controlled device with a track assembly 14, a cab 16, a first arm 18, a first hydraulic device 20, a second arm 22, a second hydraulic device 24 and a third hydraulic device 26 with the bi-directional sled 10 being attached to a distal end of the second arm 22 and a distal end of the third hydraulic device 26.

The cab 16 (also referred to as the house 16) can pivot about a vertical axis $A_1$ relative to the track assembly 14 in a conventional manner. The movement of the first arm 18 about a horizontal axis defined along the front of the cab 16 is provided by operation of the first hydraulic device 20. The movement of the second arm 22 about another horizontal axis (not shown) that extends through a distal end of the first arm 18 is provided by operation of the second hydraulic device 20. Movement of the bi-directional sled 10 relative to a distal end of the second arm 22 is provided by operation of the first, second and third hydraulic devices 20, 24 and 26, as described in greater detail below.

The excavating machine 12 and the bi-directional sled 10 are part of a dredging system 30. The dredging system 30 further includes a suction pipe 32, a pump 34, a slurry pipe 36, a water supply pipe 38 and a water supply pump 40.

The suction pipe 32 is attached to the bi-directional sled 10. The pump 34 is connected to the suction pipe 32 and draws slurry up from the bi-directional sled 10 into and through the suction pipe 32 when operating, as shown in FIG. 1. The pump 34 further pumps the slurry or dredge spoils into a barge (not shown) or other slurry receiving vessel (not shown) via the slurry pipe 36.

The suction pipe 32 can include a flotation device(s) 42 such as those disclosed in application Ser. No. 17/668,099, filed Feb. 9, 2022, and Ser. No. 17/832,827, filed Jun. 6, 2022. The disclosures of both application Ser. Nos. 17/668,099, and 17/832,827 are incorporated herein below in their entirety.

The bi-directional sled 10 includes a support structure 50, a shroud assembly 52 (hereinafter referred to as the shroud assembly 52) and a water nozzle assembly 54.

The support structure 50 of the bi-directional sled 10 includes parallel central panels 60, side panels 62 and a shroud panel 64, as shown in FIGS. 3-13. The central panels 60 are spaced apart from one another and are dimensioned and shaped to couple to a distal end 22*a* of the second arm 22 of the excavator 12 (aka the excavating machine 12) and a distal end of the third hydraulic device 20 via shafts 60*a* and 60*b*. The support structure 50 also includes fulcrum bars 66 and fulcrum plate 68.

More specifically, upper rearward ends of the central panels 60 are attached to the distal end of the second arm 22 via the shaft 60*a*. The fulcrum bars 66 are directly attached at respective ends thereof to portions of the second arm 22 spaced apart from the distal end 22*a* of the second arm 22 of the excavator 12 via the shaft 60*c*. Opposite ends of the fulcrum bars 66 are directly attached to the distal end of the third hydraulic device 20 via shaft 60*d*. The fulcrum plate 68 is attached at an upper end thereof the distal end of the third hydraulic device 20. A lower end of the fulcrum plate 68 is attached to the central panels 60 via the shaft 60*b*.

The fulcrum bars 66 and fulcrum plate 68 define fulcrum points that assist in positioning and orienting of the bi-directional sled 10 via operation of the excavating machine 12.

As shown in FIGS. 3-7, the support structure 50 is constructed with lower ends of each of the central panels 60 attached to the shroud panel 64. The side panels 62 are fixed to opposite sides of the shroud panel 64 parallel to the central panels 60.

Figure 6:
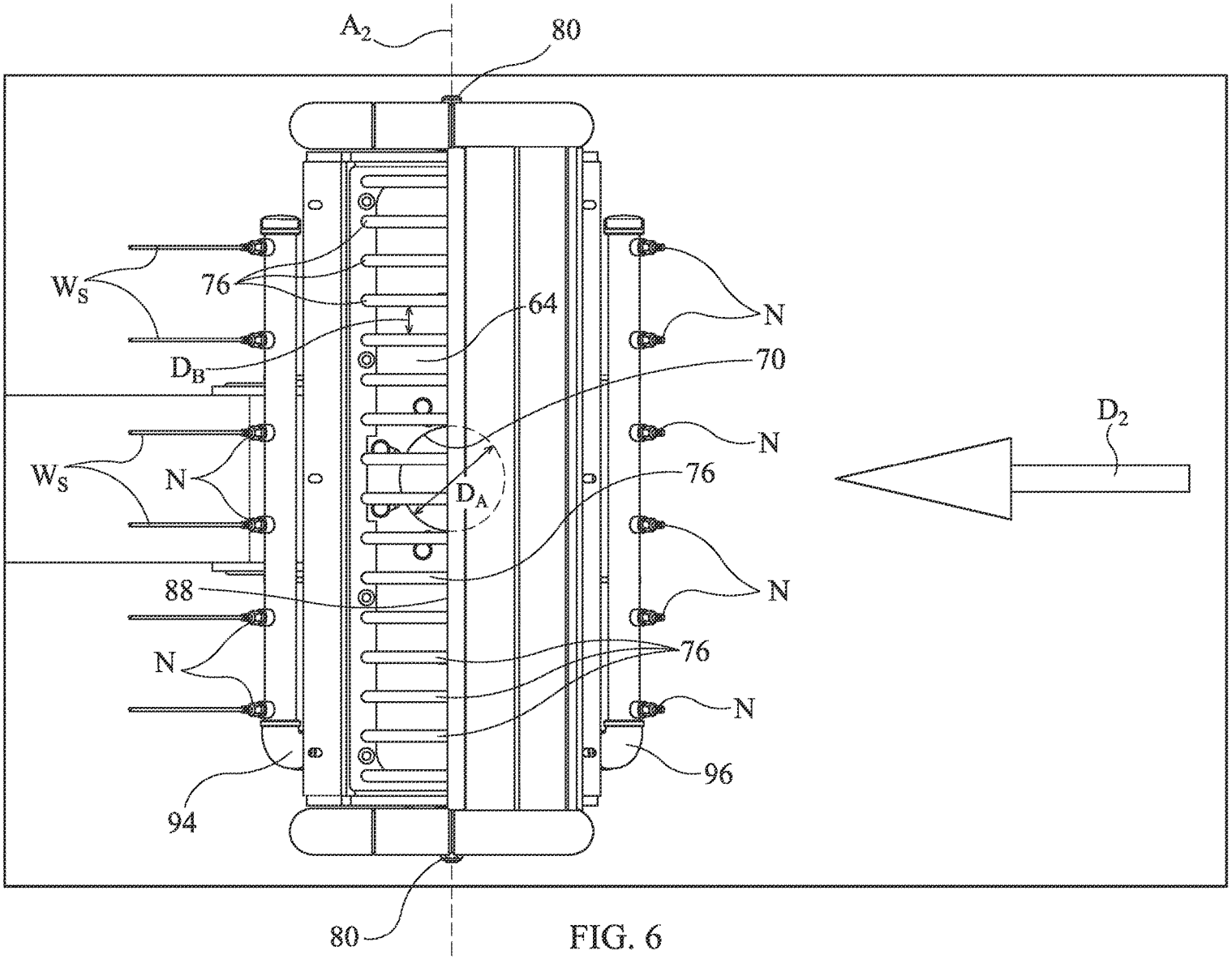
FIG. 6 is a bottom view of the bi-directional sled shown being moved in the second direction with the shroud assembly in the second orientation showing the classifier bars and the shroud attached to the pair of runners in accordance with the first embodiment.

The shroud panel 64 is an elongated metal plate that can include a contoured shape in order to divert slurry toward a central slurry outlet 70 shown in FIG. 6. The central slurry outlet 70 defines a first diameter DA. A pipe 72 is attached to the shroud panel 64 with a lower end being concentric with the slurry outlet 70. The suction pipe 32 is attached to an upper end of the pipe 72, as shown in FIGS. 1-4.

The support structure 50 further includes a plurality of classifier bars 76 having an overall curved or curvilinear shape. The plurality of classifier bars 76 are spaced apart from one another by a distance $D_B$ that is less than the first diameter $D_1$.

As shown in FIGS. 5-14, the shroud assembly 52 includes pivot shafts 80, a pair of runners 82 and a shroud 84. The shroud 84 is an elongated panel having a first end fixed to one of the runners 82 and a second end fixed to the other of the runners 82.

As shown in FIGS. 7-10 and 12-14, each of the runners 82 as a curvilinear shape with curved portions and straight portions. Each of the two runners 82 include a corresponding one of the pivot shafts 80, as described further below. During movement of the bi-directional sled 10, the runners 82 pivot about the pivot shafts 80 and, in effect, serve as wheels that can undergo limited pivoting movement, as is described in greater detail below.

The shroud 84 can have a curved or contoured shape. Upper and lower surfaces of the shroud 84 are preferably approximately parallel to an axis $A_2$ that extends through each of the pivot shafts 80. Exposed edges 86 and 88 of the shroud 84 define leading edges that initially break up and then scoop up debris and slurry during the dredging process, as is described further below.

The pivot shafts 80 are co-axially aligned with one another and define the axis $A_2$ that extends through the support structure 50. The pivot shafts 80 are supported by corresponding ones of the side panels 62 of the support structure 50 for pivotal movement such that the shroud assembly 52 pivots about the axis $A_2$. The side panels 62 can each include bearings (not shown) that are co-axially aligned with the pivot shafts 80 and support the pivot shafts 80 to corresponding ones of the side panels 62 of the support structure 50.

The shroud assembly 52 can pivot between a first orientation and a second orientation. The first orientation is shown at the left side of FIGS. 1, 2 and 5 and in FIGS. 3, 7 and 12. The second orientation is shown in at the right side of FIGS. 1, 2 and 5 and also in FIGS. 4, 8 and 14.

Figure 14:
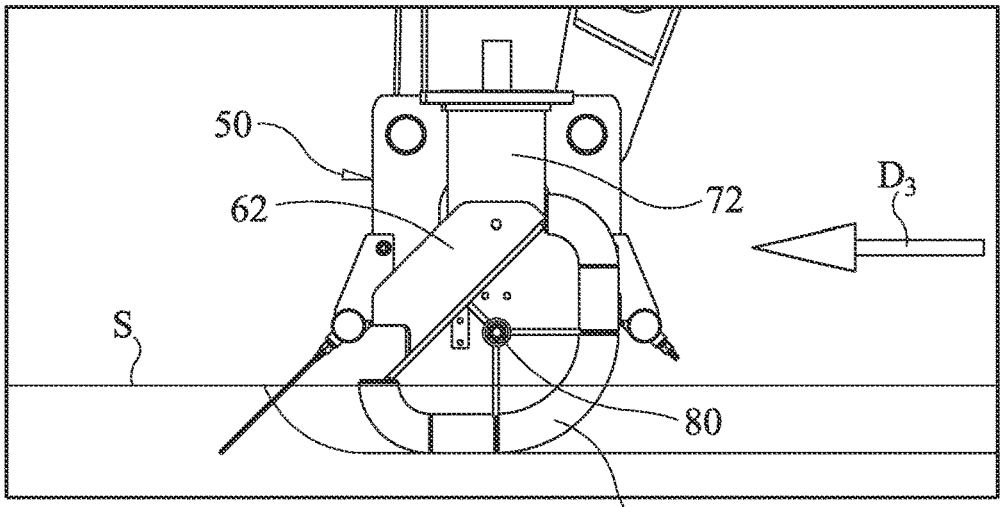
FIG. 14 is another side view of the bi-directional sled showing the runner of the shroud assembly in the second orientation while moving in the second direction with water spraying from the nozzles of the first manifold in accordance with the first embodiment.
Figure 15:
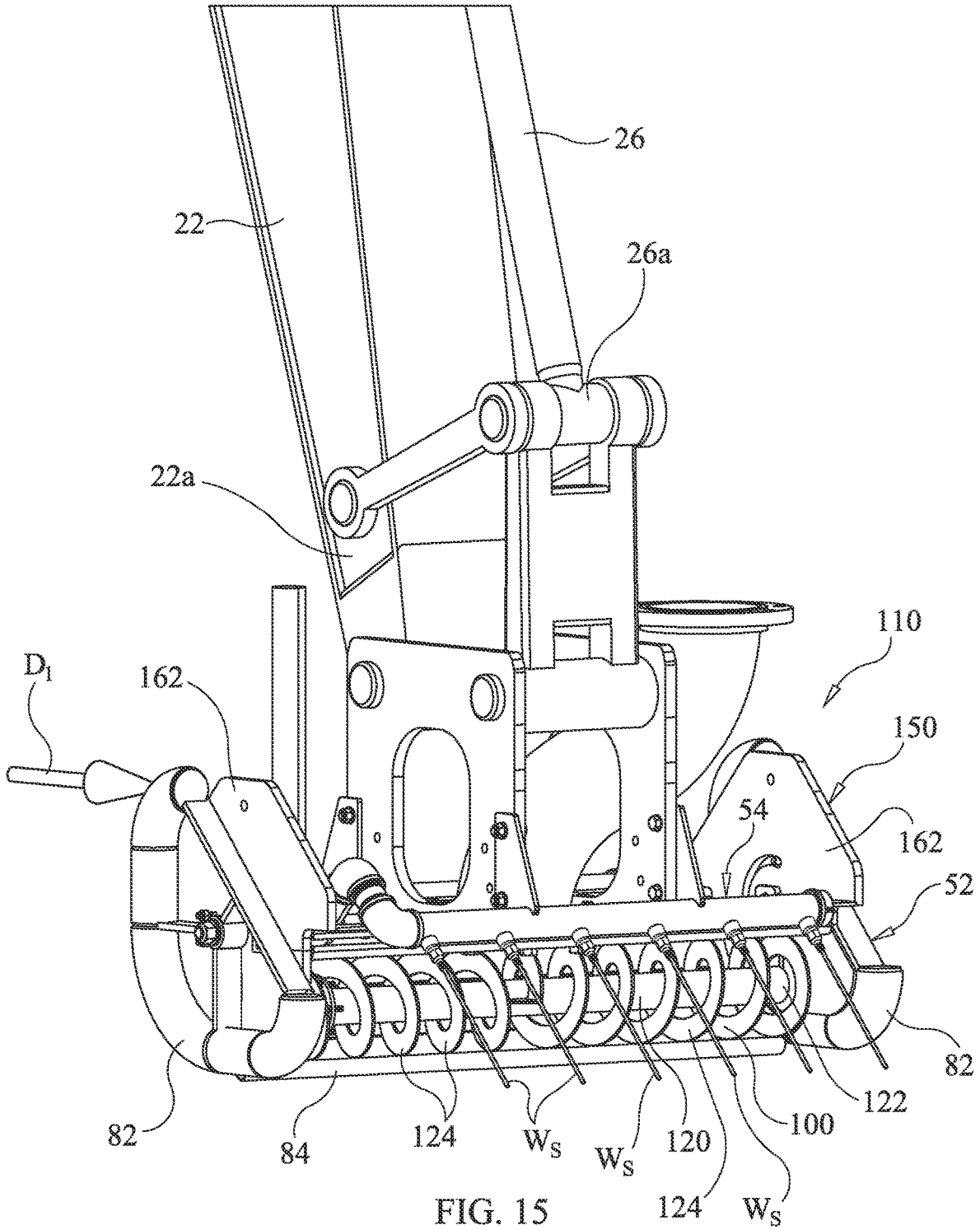
FIG. 15 is a perspective view of a bi-directional sled showing details of a support structure that attaches the bi-directional sled to the excavating machine and includes a shroud panel (an upper shroud panel) and an auger attached for rotational movement to the shroud panel, along with details of the shroud assembly which including a shroud (a lower shroud panel) and a pair of runners with the shroud assembly shown in a first orientation in accordance with a second embodiment.
Figure 16:
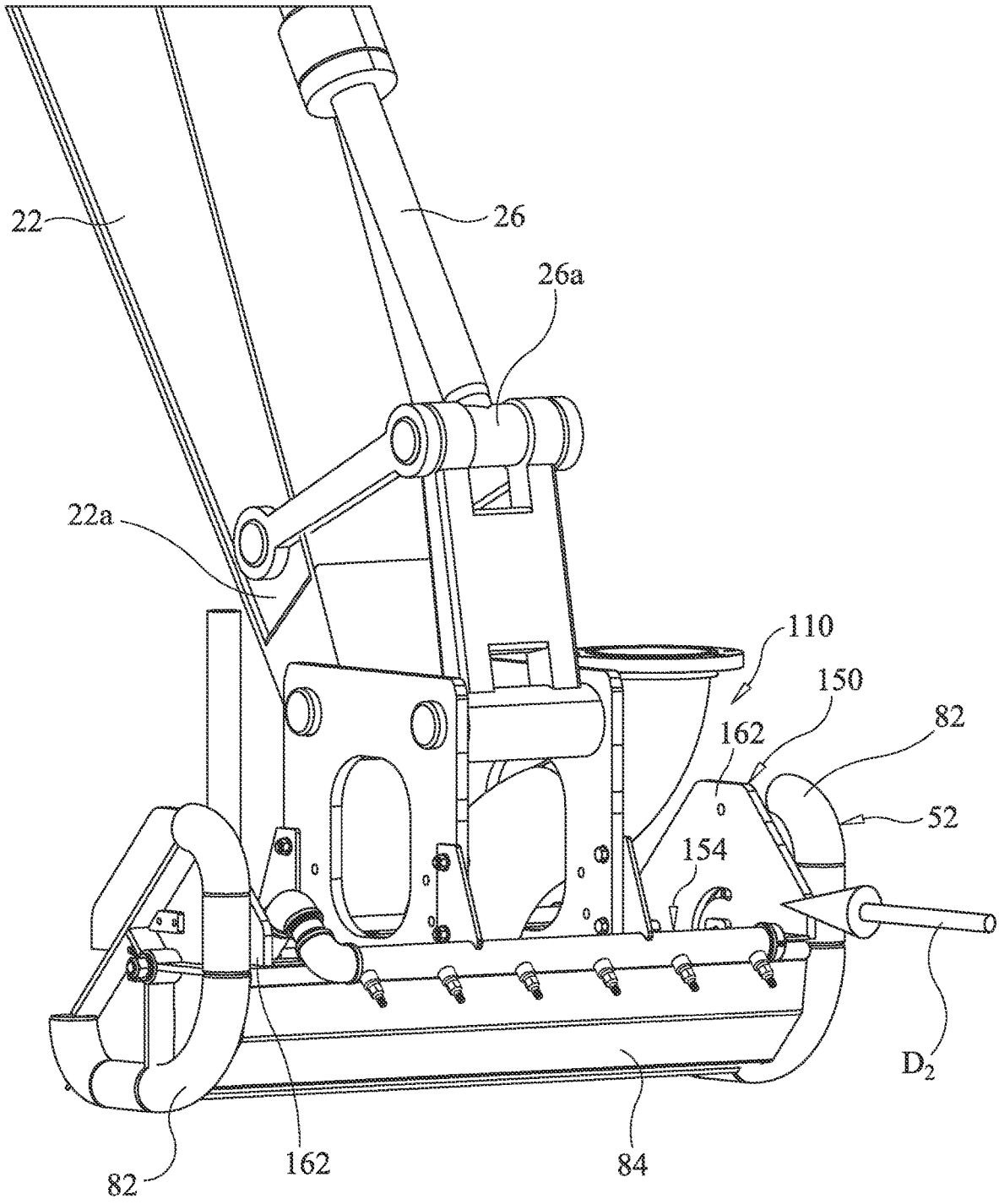
FIG. 16 is another perspective view of the bi-directional sled similar to FIG. 15 showing the shroud assembly shown in a second orientation in accordance with the second embodiment.
Figure 17:
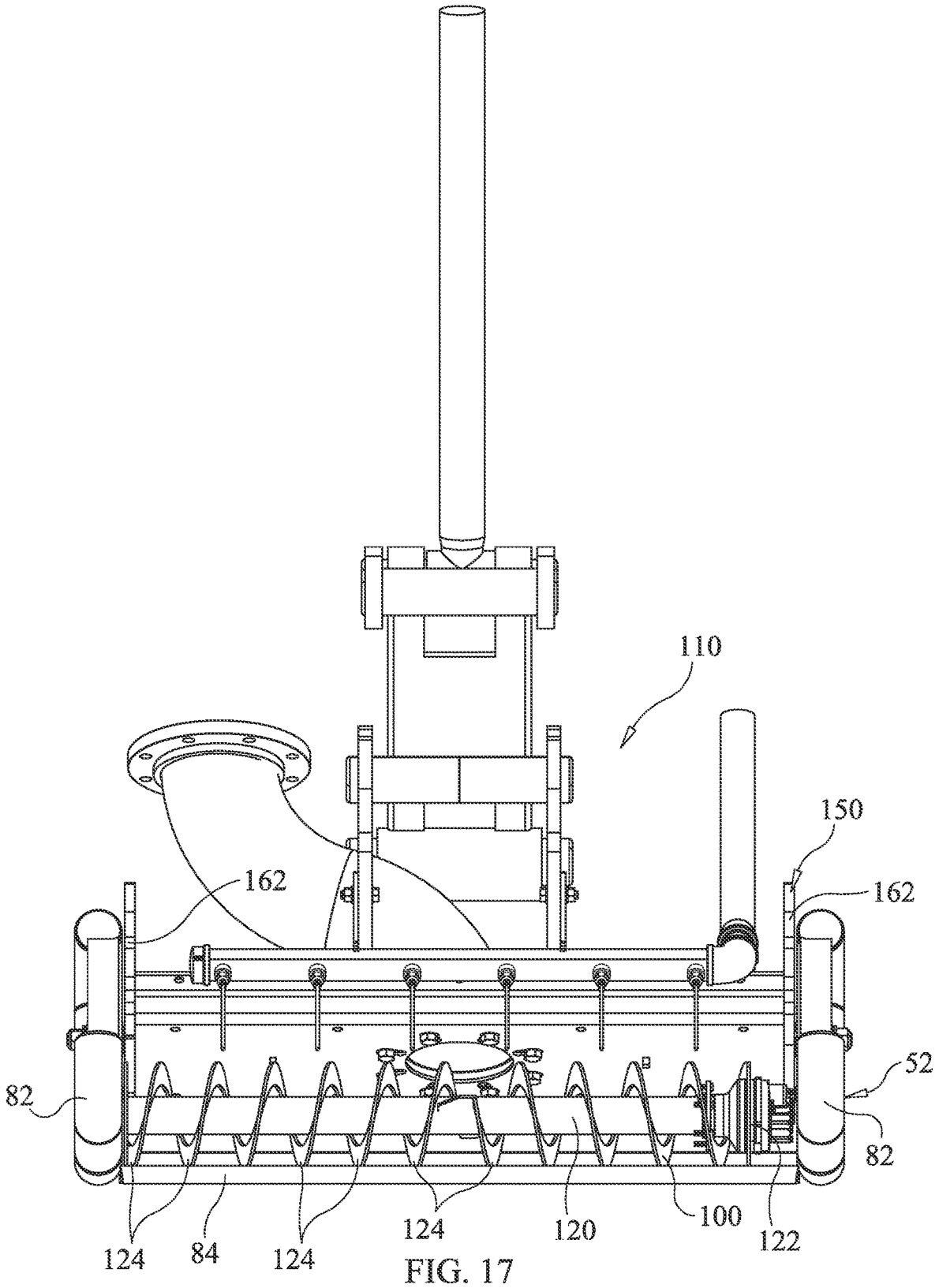
FIG. 17 is a front view of the bi-directional sled showing the shroud assembly shown in a first orientation with the auger fully exposed for breaking up material to be dredged in accordance with the second embodiment.
Figure 18:
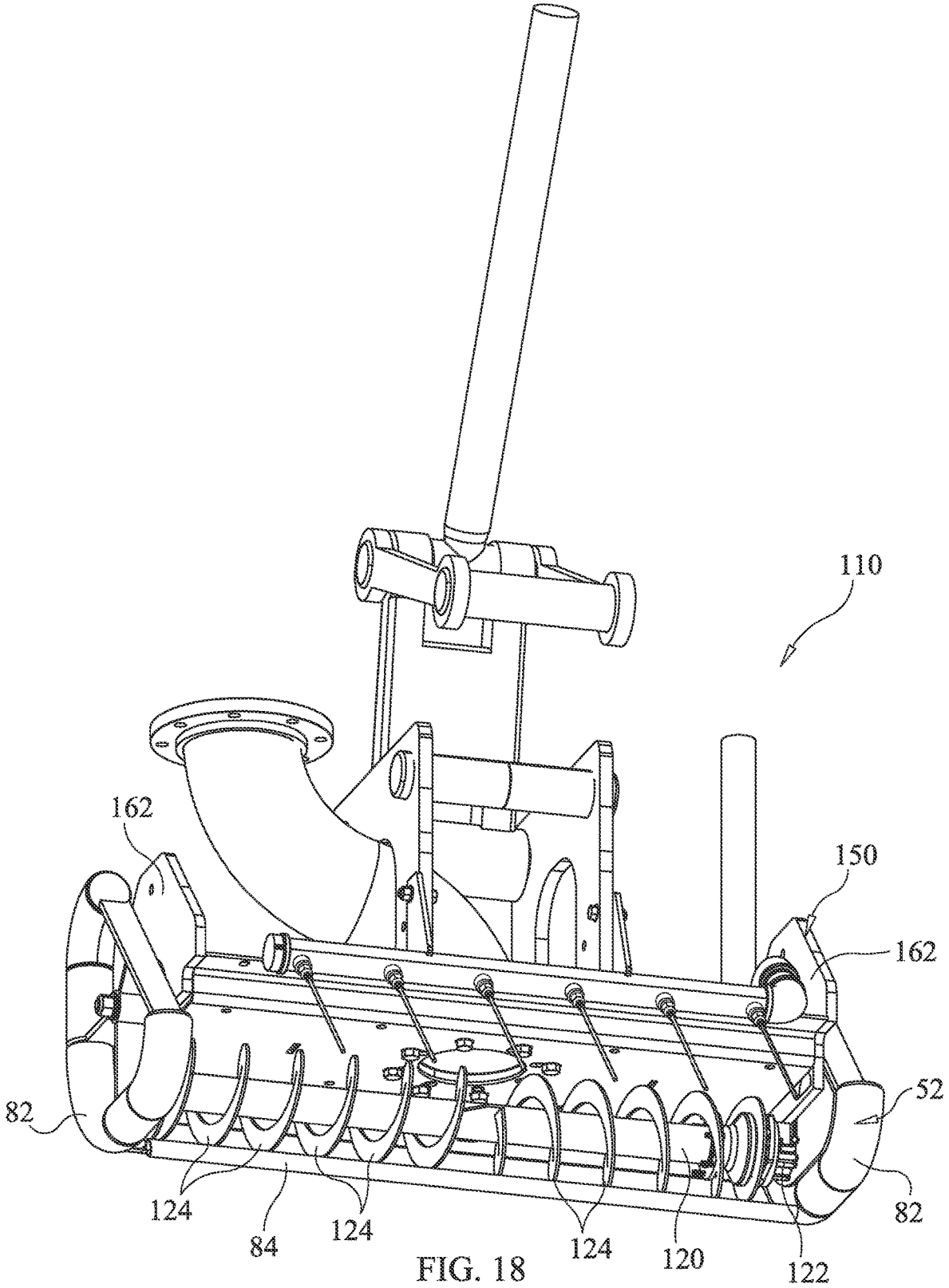
FIG. 18 is a rear perspective view of the bi-directional sled showing the shroud assembly shown in the first orientation with the auger fully exposed for breaking up material to be dredged in accordance with the second embodiment.
Figure 19:
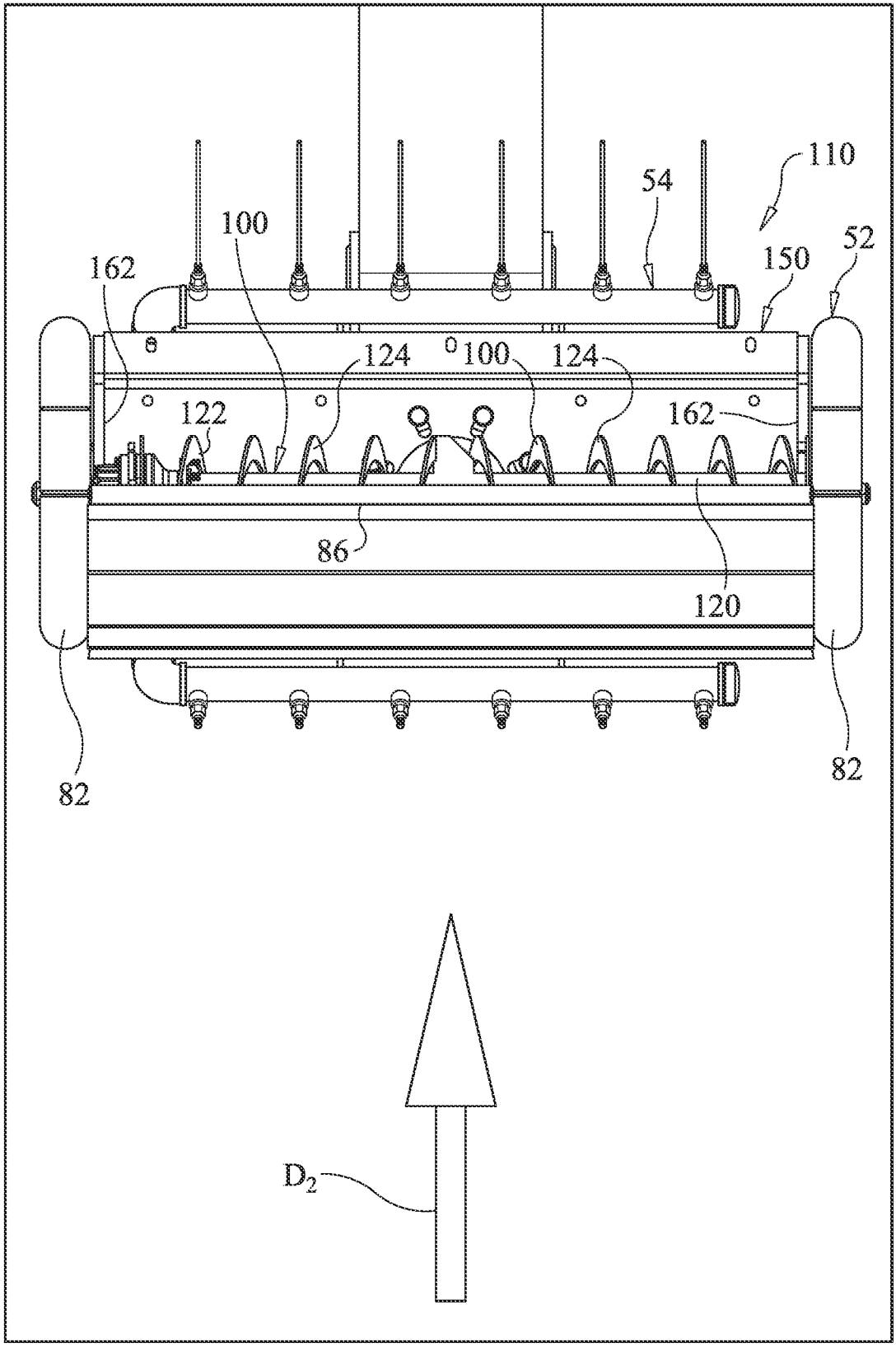
FIG. 19 is a bottom view of the bi-directional sled shown being moved in the second direction with the shroud assembly in the second orientation showing the auger attached to the pair of side panels of the support structure in accordance with the second embodiment.
Figure 20:
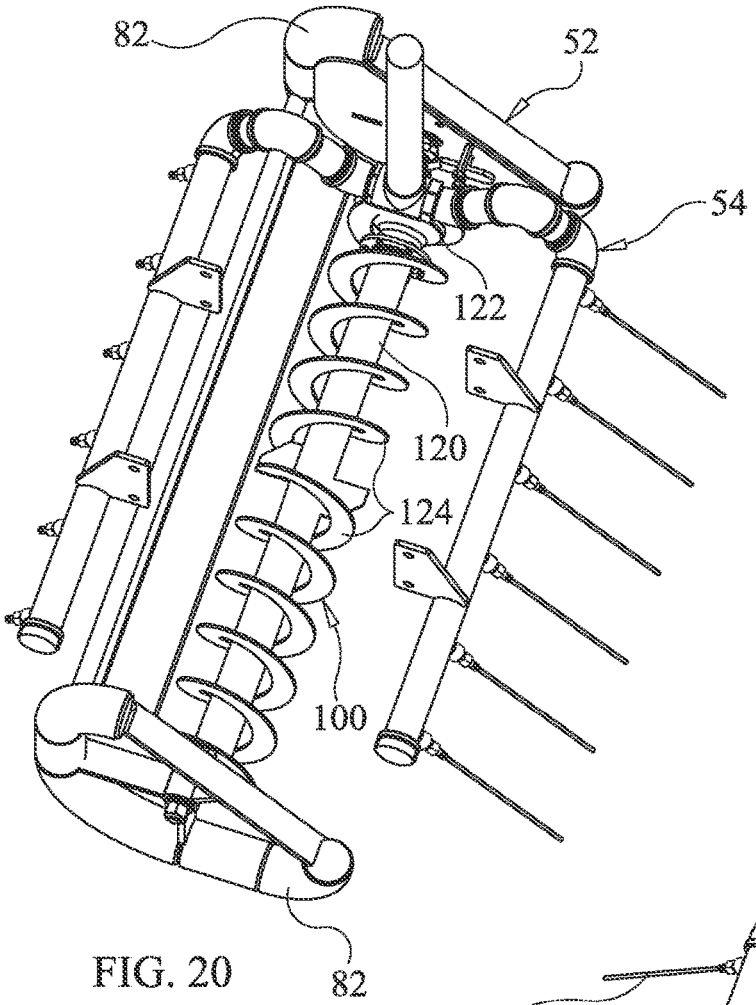
FIG. 20 is a perspective view of the bi-directional sled with the support structure removed from the bi-directional sled showing only the shroud assembly, the auger and the water nozzle assembly with the shroud assembly in the first orientation in accordance with the second embodiment.
Figure 21:
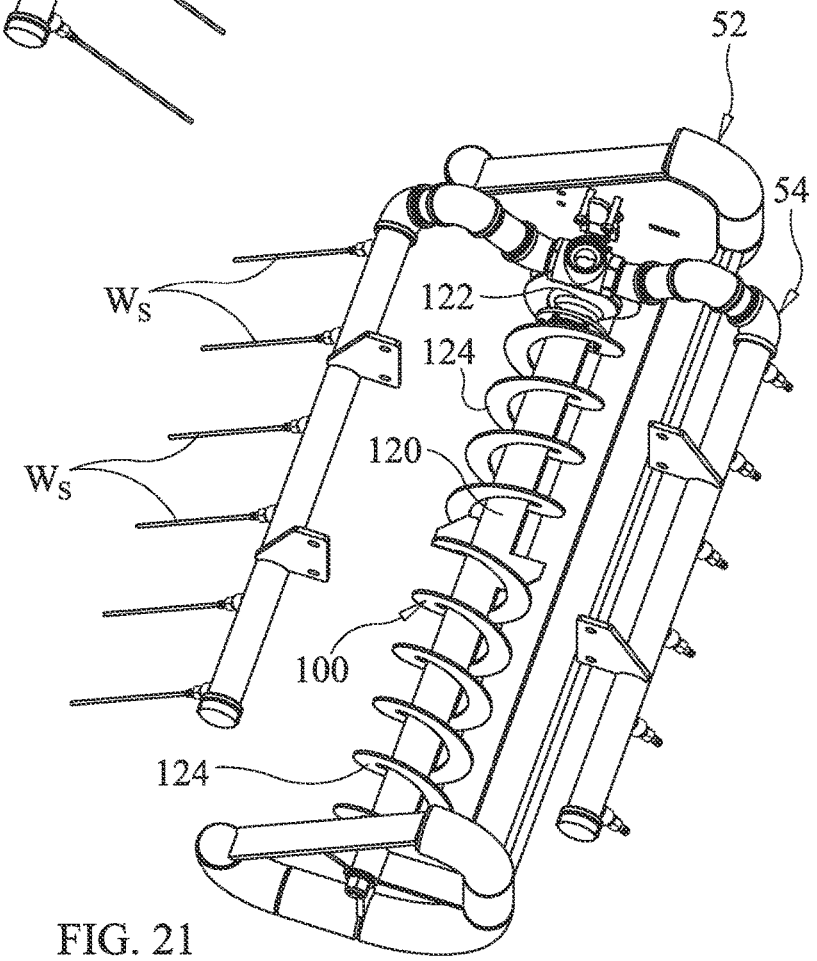
FIG. 21 is another perspective of the bi-directional sled with the support structure removed from the bi-directional sled showing only the shroud assembly, the auger and the water nozzle assembly with the shroud assembly in the second orientation in accordance with the second embodiment.
Figure 22:
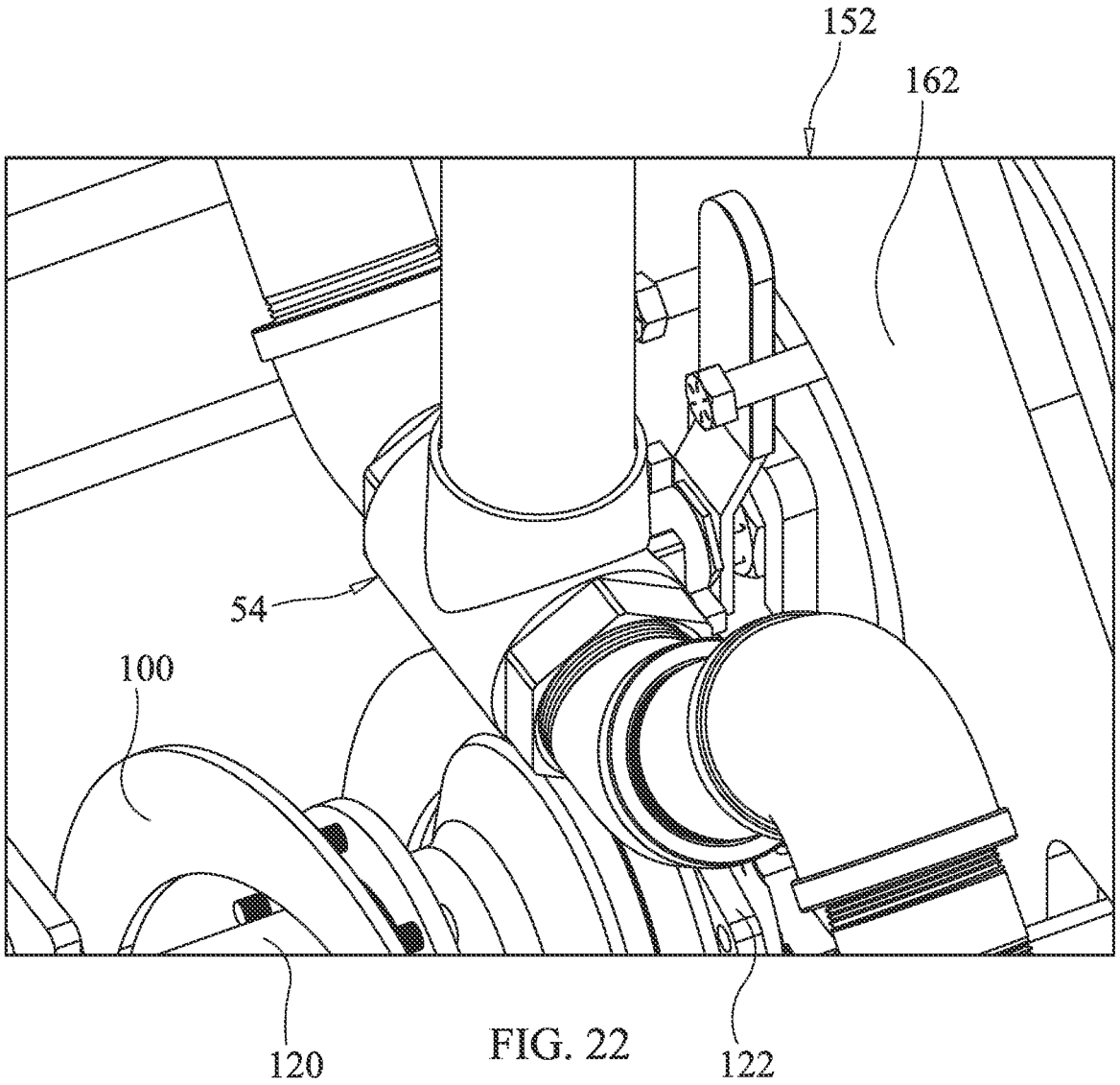
FIG. 22 is a perspective view of an upper portion of the support structure showing the valve of the water nozzle assembly with the valve contacting structures contacting the lever of the valve with the motor of the auger located below the valve in accordance with the second embodiment.

The shroud assembly 52 is shaped and configured such that with the shroud assembly 52 being moved by the excavating machine 12 in a first direction $D_1$ along a bottom surface S of a channel or body of water W, the curvilinear shape of the runners 82 causes the shroud assembly 52 to pivot to the first orientation. Since the shroud 84 is fixedly attached to the runners 82, the shroud 84 pivots with the runners 82. Conversely, with the shroud assembly 52 being moved by the excavating machine 12 in a second direction $D_2$ along the bottom surface S of the channel or body of water W, the curvilinear shape of the runners 82 causes the shroud assembly 52 to pivot to the second orientation. Hence, friction between the bottom surface S of the channel and the runners 82 cause the runners 82 to function as wheels that pivot and re-position the shroud assembly 52 between the first orientation (FIG. 12) and the second orientation (FIG. 14).

Figure 7:
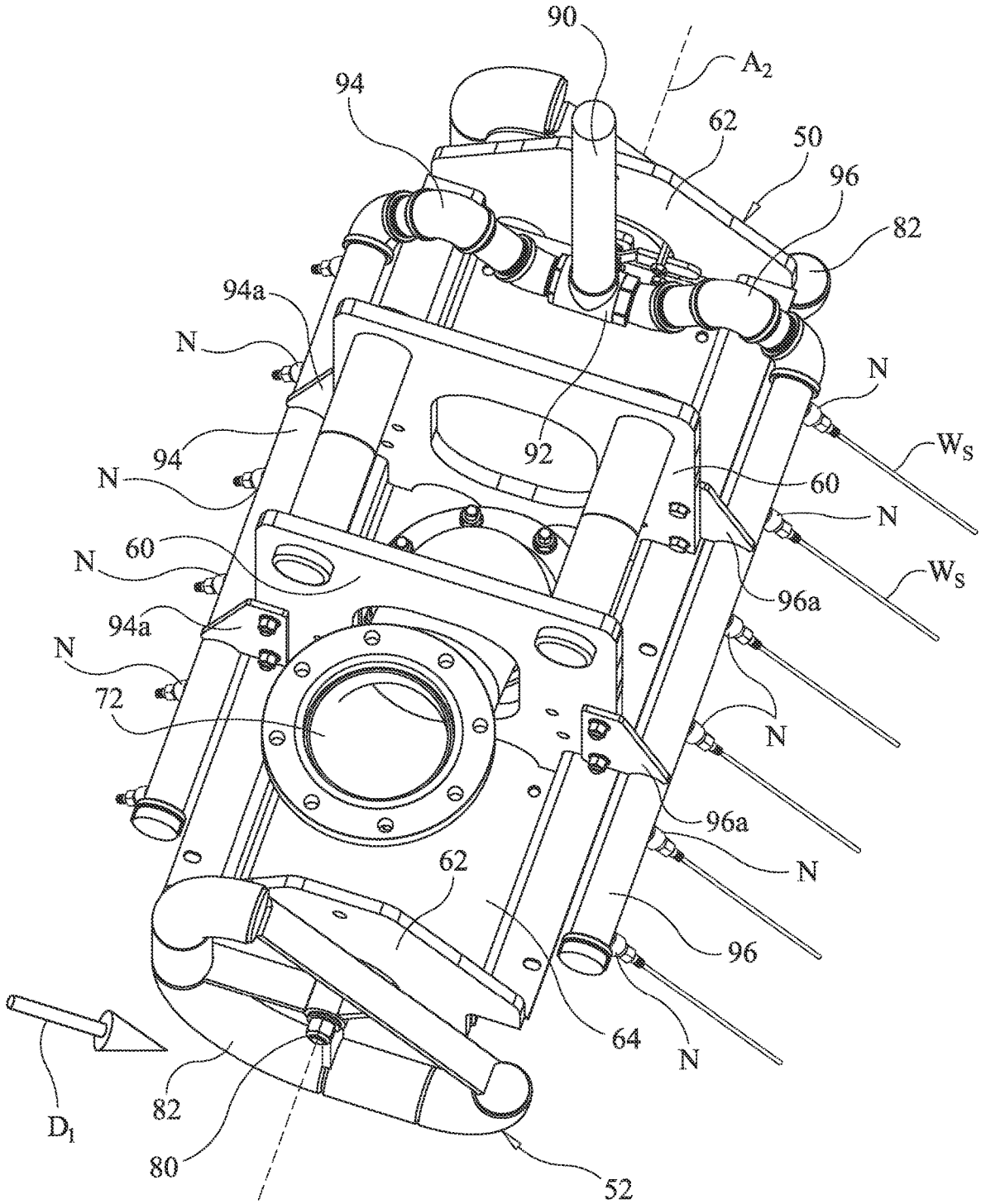
FIG. 7 is a perspective view of an upper side of the bi-direction shed removed from the excavating machine showing the support structure, runners of the shroud assembly and a water nozzle assembly, the water nozzle assembly including a first manifold, a second manifold and a valve operably located between the first and second manifolds, the valve being set to provide pressurized water to the second manifold with the bi-directional sled being moved the first direction and the shroud assembly in the first orientation such that water is spraying from nozzles of the second manifold in accordance with the first embodiment.
Figure 8:
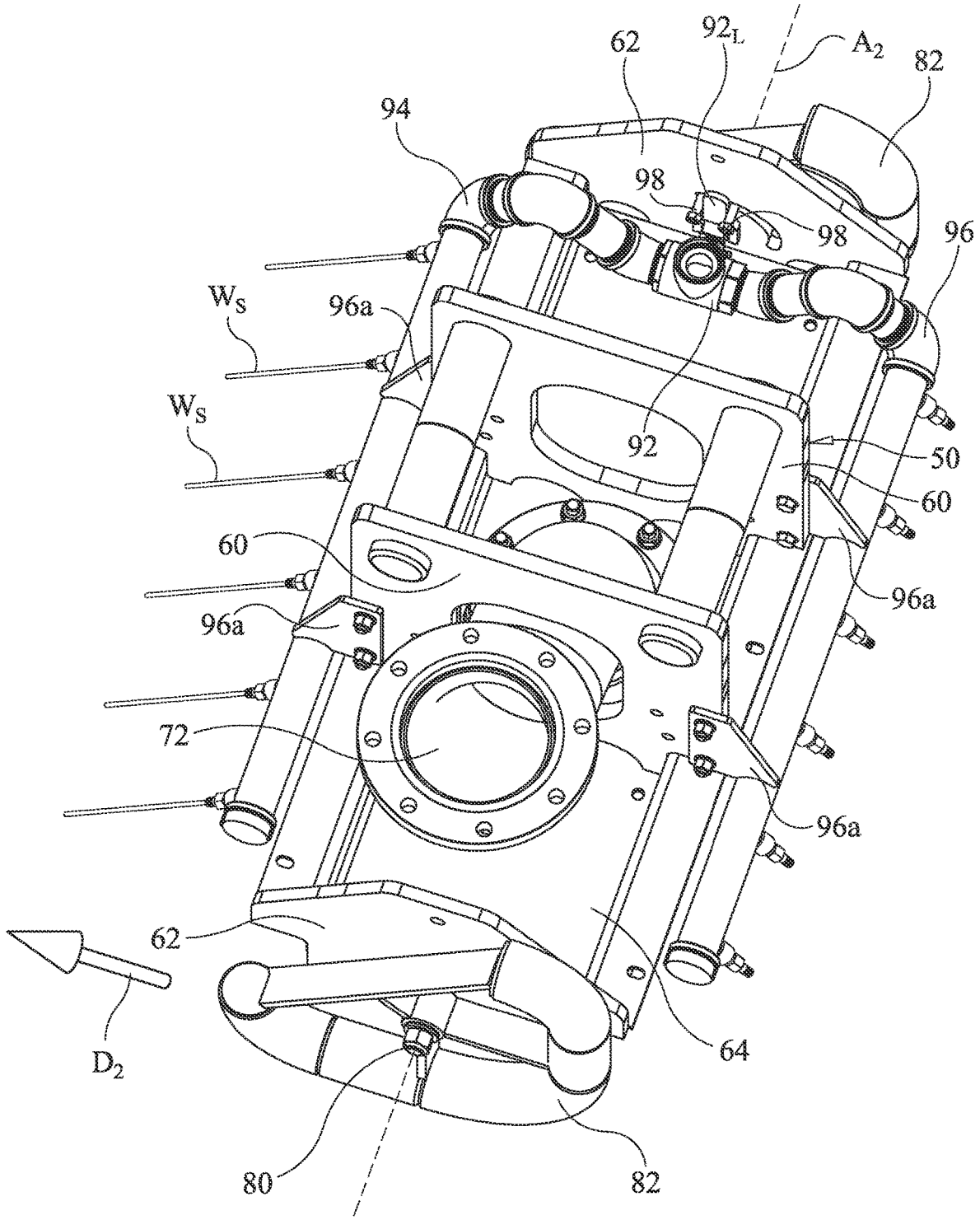
FIG. 8 is a perspective view of the upper side of the bi-direction shed similar to FIG. 7 showing the runners of the shroud assembly moved to the second orientation while the bi-directional shed is moving in the second direction and with valve contacting structures of one of the runners having moved a valve lever of the valve such that pressurized water is now provided to the first manifold with the shroud assembly in the second orientation such that water is spraying from nozzles of the first manifold in accordance with the first embodiment.
Figure 12:
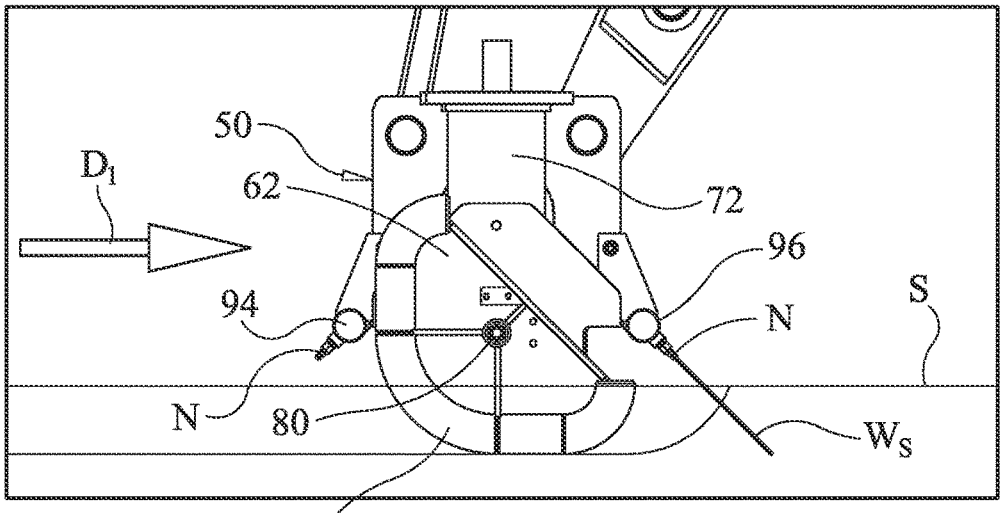
FIG. 12 is a side view of the bi-directional sled showing the runner of the shroud assembly in the first orientation while moving in the first direction with water spraying from the nozzles of the second manifold in accordance with the first embodiment.
Figure 13:
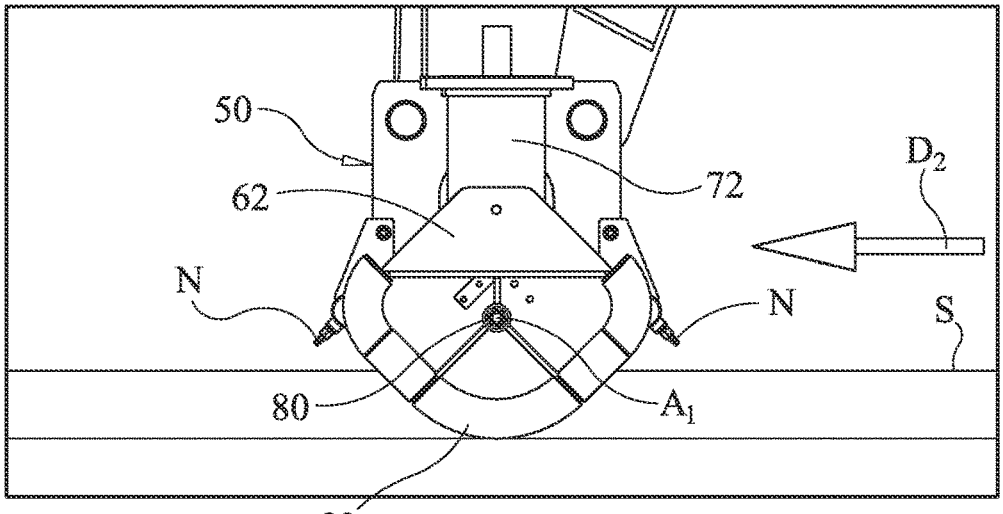
FIG. 13 is a side view of the bi-directional sled showing the runner of the shroud assembly moved to an intermediate orientation during a process of reversing the direction of movement from moving in the first direction to moving in the second direction in accordance with the first embodiment.

For example, as shown in FIGS. 7 and 12, while moving in the first direction $D_1$, the curvilinear shape of the runners 82 generates friction while in contact with bottom surface S keeping the shroud assembly 52 in the first orientation. As shown in FIG. 13, when movement in the first direction $D_1$ ceases and movement in the second direction $D_2$ begins, the runners 82 cause the shroud assembly 52 to begin to pivot through an intermediate position. Continued movement in the second direction $D_2$ causes the shroud assembly 52 to pivot to the second orientation, as shown in FIGS. 8 and 14. The reverse, where movement of the shroud assembly 52 changes from the second direction $D_2$ to the first direction $D_1$ the causes the shroud assembly 52 to pivot from the second orientation (FIG. 14) to the first orientation (FIG. 12).

Figure 9:
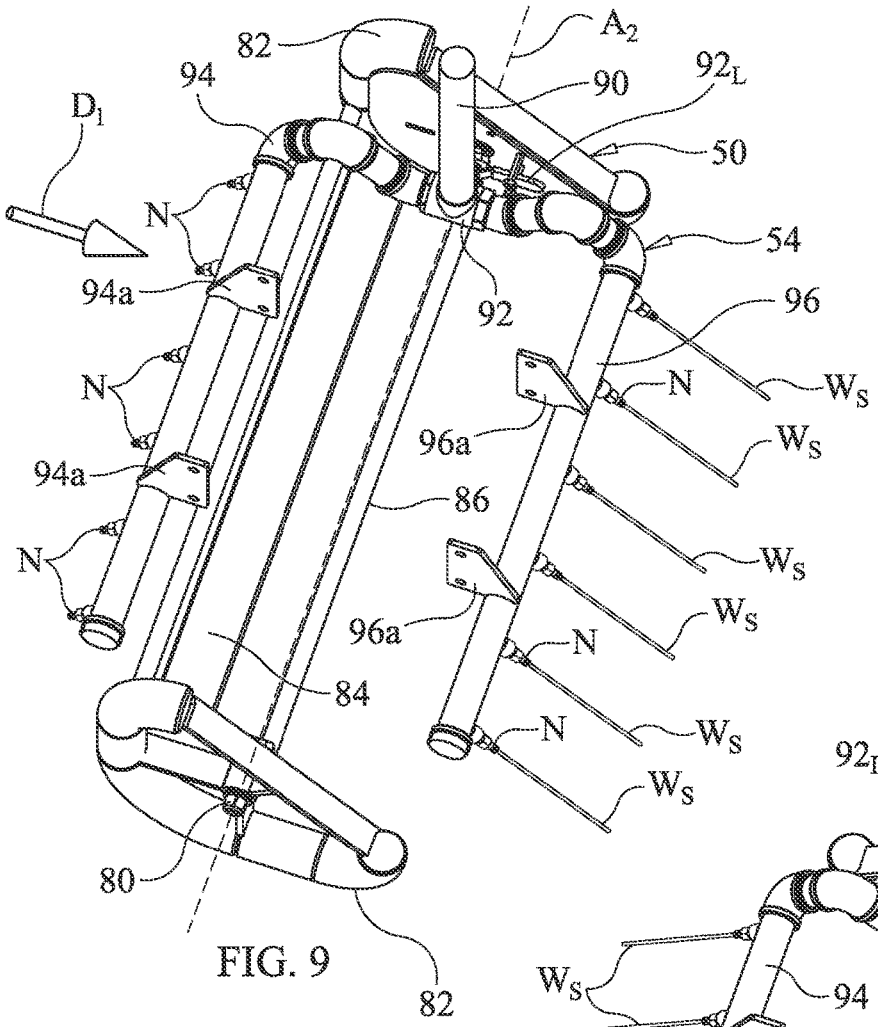
FIG. 9 is another perspective view similar to FIG. 7 with the support structure removed from the bi-directional sled showing only the shroud assembly and the water nozzle assembly with the shroud assembly in the first orientation in accordance with the first embodiment.
Figure 10:
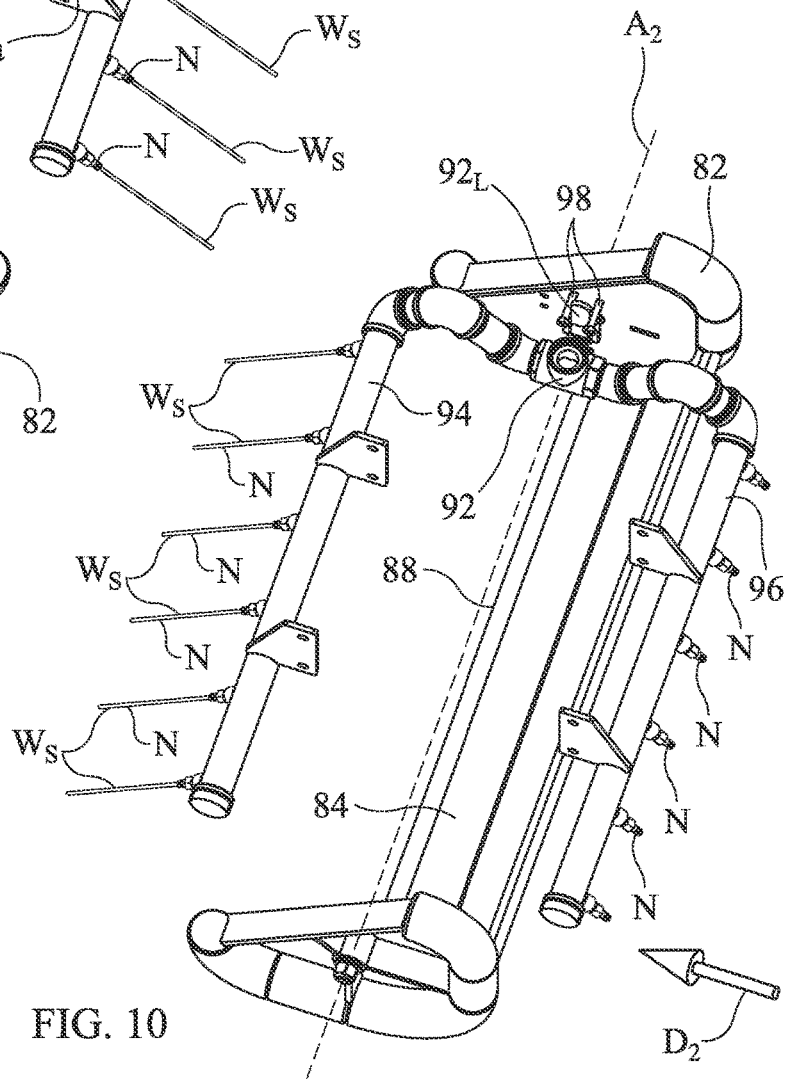
FIG. 10 is another perspective view similar to FIG. 8 with the support structure removed from the bi-directional sled showing only the shroud assembly and the water nozzle assembly with the shroud assembly in the second orientation in accordance with the first embodiment.

The shroud 84 has a first edge 86 shown in FIG. 9 and a second edge 88 shown in FIG. 10 opposite the first edge 86. The first edge 86 acts as a blade or shovel edge when the bi-directional sled 10 is moved in the first direction $D_1$ with the shroud assembly 52 moved to the first orientation. The second edge 88 acts as a blade or shovel edge when the bi-directional sled 10 is moved in the second direction $D_2$ with the shroud assembly 52 pivoted to the second orientation.

In other words, with the excavating machine 12 moving the support structure 50 and the shroud assembly 52 in the first direction $D_1$, the shroud assembly 52 automatically (via friction) moves to the first orientation and the edge 86 scoops up debris from the bottom surface S. With the excavating machine 12 moving the support structure 50 and the shroud assembly 52 in the second direction $D_2$, the shroud assembly 52 automatically (via friction) moves to the second orientation and the edge 88 further scoops up debris from the bottom surface S. With the pivoting capability of the shroud assembly 52 relative to the support structure 50, there is no need to operate the excavating machine 12 to lift the bi-directional sled 10 in order to reposition the bi-directional sled 10 for a subsequent scooping up of material. Rather, the excavating machine 12 operator only has to reverse direction of movement of the bi-directional sled 10 during a dredging operation.

It should be understood from the drawings and the description herein that each of the edges 86 and 88 can be provided with cutting teeth in order to loosen debris along the bottom surface S.

The shroud panel 64 of the support structure 50 includes the slurry outlet 70. As the excavating machine 12 moves the bi-directional sled 10 in the first direction $D_1$ and the second direction $D_2$ along the bottom surface S, material dredged by the shroud 84 is directed between the classifier bars 76 and toward the slurry outlet 70. The classifier bars 76 serve two purposes. First, the classifier bars 76 help to break up large clumps of debris and also prevent rocks larger than the distance $D_B$ from passing into the area between the shroud panel 64 and the shroud 84. Further, the curved shape of the shroud 84 is such that dredged material that has passed into the area between the shroud panel 64 and the shroud 84 is pushed upward toward the shroud panel 64 allowing suction via the pump 34, the suction pump 32 and the slurry outlet 70 to further draw debris and dredged material away from the bottom surface S. As shown in FIG. 6, the shroud 84 is located below the classifier bars 76.

As shown in FIGS. 7-10, the water nozzle assembly 54 (also referred to as a water spraying structure 54) includes a feed pipe 90, a valve 92, a first manifold 94 and a second manifold 96. The first and second manifolds 94 and 96 are attached to the support structure 50 via attachment plates 94*a* and 96*a*. Each of the first and second manifolds 94 and 96 includes a plurality of nozzles N such that when pressurized water is fed to either of first and second manifolds 94 and 96 the corresponding nozzles N spray water $W_S$ (water spraying $W_S$). More specifically, each of the first and second manifolds 94 and 96 is dimensioned and shaped to spray water $W_S$ on material being dredged.

Figure 11:
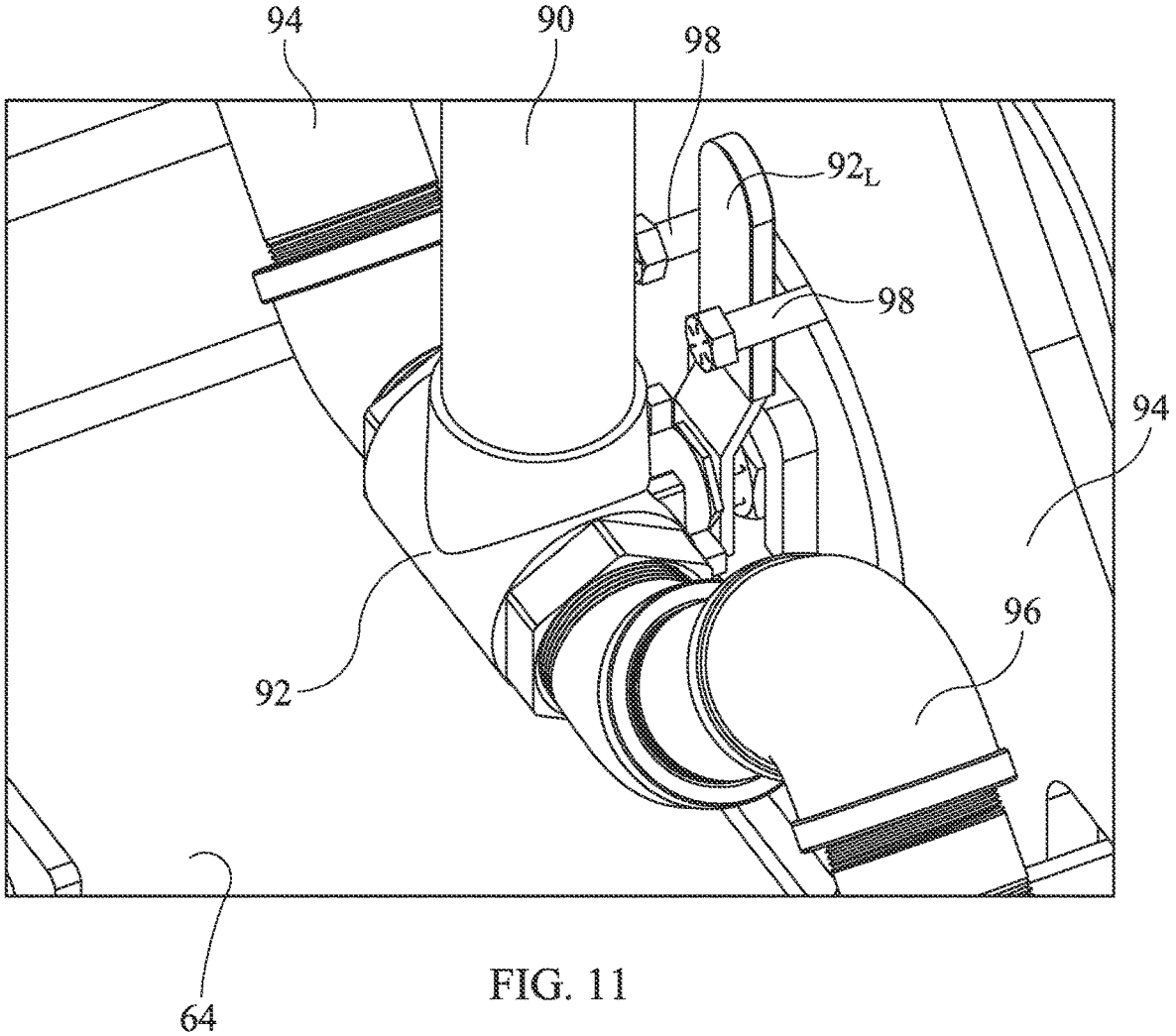
FIG. 11 is a perspective view of an upper portion of the support structure showing the valve of the water nozzle assembly with the valve contacting structures contacting the lever of the valve in accordance with the first embodiment.

As shown in FIGS. 8, 10 and 11, the valve 90 is located between the first manifold 94 and the second manifold 96. Further, one of the pair of runners 82 includes valve contacting structures 98 that extend through a slot in the adjacent side panel 62 and contact a valve lever $\mathbf{92}_L$ of the valve 92. Pivoting movement of the runner 82 moves the valve contacting structures 98 and the valve lever $\mathbf{92}_L$, thereby causing the valve 92 to direct pressurized water to an appropriate one of the first manifold 94 and the second manifold 96.

As shown in FIG. 9 with the shroud assembly 52 moving or having been recently moved in the first direction $D_1$ relative to material to be dredged a valve lever 90L of the valve 90 is moved to a first position such that pressurized water from the water supply pump 40 via the water supply pipe 38 and the feed pipe 90 is further directed via the valve 90 to the second manifold 96 and the nozzles N of the second manifold 96.

As shown in FIG. 10 with the shroud assembly 52 moving or having been recently moved in the second direction D: relative to material to be dredged a valve lever 90L of the valve 90 is moved to a second position such that pressurized water from the water supply pump 40 via the water supply pipe 38 and the feed pipe 90 is further directed via the valve 90 to the first manifold 94 and the nozzles N of the first manifold 94.

During operation of the dredging system 30 during which the excavating machine 12 moves the bi-directional sled 10 back and forth in the first direction $D_1$ and the second direction $D_2$, the following occurs. Pressurized water pumped to the water nozzle assembly 54 to water $W_S$ to spray out the nozzles N of the corresponding one of the first manifold 94 or the second manifold 96. The spraying water $W_S$ loosens earth and/or debris to be dredged so that the movement of the bi-directional sled 10 can cause the corresponding one of the exposed edges 86 and 88 of the shroud 84 to scoop up the debris and/or earth. The debris and/or earth is pushed by the motion of the bi-directional sled 10 between the classifier bars 76 and into a space defined between the shroud 84 and the shroud panel 64. Thereafter, suction provided by the pump 34 urges the debris and/or earth through the central slurry outlet 70 and upward through the suction pipe 32. When the operator of the excavating machine 12 determines that the bi-directional sled 10 has moved a sufficient distance in one of the first direction $D_1$ or the second direction $D_2$, the operator reverses the direction of movement of the bi-directional sled 10 to the other of the first direction $D_1$ or the second direction $D_2$ without lifting the bi-directional sled 10 from the bottom surface S of the body of water W. Since the movement of the bi-directional sled 10 in the first direction $D_1$ and the second direction $D_2$ provides the same scooping and collecting capability, the dredging operation is more efficient and more effective than dredging systems where the sled can only loosen and scoop up debris while only moving in a single direction.

It should be understood from the drawings and the description herein that the excavating machine 12 can have hydraulics or any other suitable devices to move the first arm 18, the second arm 22, the cab 16 and the bi-directional sled 10 in a conventional manner, as is known in the art.

The water supply pump 40 can be a self-priming pump includes an impeller and a volute casing (not shown). The impeller and volute casing can be surrounded by a tank so that it will always be immersed in a liquid sufficient to start the pump and provide the pump with lubrication and cooling. As can be understood, self-priming in this application means that the pump has the ability to use liquid stored in its housing to generate a vacuum on the suction line.

That is, the pump 40 can be an Eddy Pump, for example, as described in U.S. patent application Ser. No. 16/176,495, filed Oct. 31, 2018, entitled Eddy Pump, the entire contents of which are herein incorporated by reference.

Second Embodiment

Referring now to FIGS. 15-22, a bi-directional sled 110 in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

As shown in FIGS. 12-22, the bi-directional sled 110 includes a support structure 150, the shroud assembly 52 as described in the first embodiment and the water nozzle assembly 54, as is also described above in the first embodiment.

The support structure 150 includes many of the features of the support structure 50 of the first embodiment. However, the side panels 62 have been replaced by side panels 162 that include all the features of the first embodiment, but have been modified to support an auger 100, described further below. The shroud assembly 52 is the same as the first embodiment, and includes the runners 82 and the shroud 84, as described in the first embodiment.

The auger 100 includes a shaft 120, a rotation motor 122 and auger blades 124. The shaft 120 is supported at opposite ends thereof for rotational movement by the side plates 162. The rotation motor 122 is also fixed to one of the side plates 162. The rotation motor 122 can be powered by pneumatic or hydraulic pressure via hoses (not shown) that extend to a pneumatic or hydraulic pump are located above the surface of the water adjacent to the excavating machine 12 (not shown in FIGS. 15-22). Alternatively, the motor 122 can be an insulated electric motor with a power cable (not shown) attached thereto and extending to a power source above the surface of the water adjacent to the excavating machine 12. Other sources of rotary power to rotate the shaft 120 and the auger blades 124 can be employed.

The auger blades 124 are welded or otherwise rigidly fixed to the shaft 120 for rotation therewith. The auger 100 can be configured to rotate in the same direction regardless of the orientation of the shroud assembly 52. Alternatively, the auger 100 can be configured to rotate in a first direction with the shroud assembly 52 in the first orientation as shown in FIG. 12 in the first embodiment, and the auger 100 can rotate in a second direction with the shroud assembly 52 in the second orientation shown in FIG. 14.

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including". "having" and their derivatives. Also, the terms "part." "section." "portion." "member" or "element" when used in the singular can have the dual meaning of a single part or a plurality of parts. Also as used herein to describe the above embodiments, the following directional terms "forward". "rearward". "above", "downward", "vertical", "horizontal", "below" and "transverse" as well as any other similar directional terms refer to those directions of a vehicle equipped with the bi-directional sled for dredging system. Accordingly, these terms, as utilized to describe the present invention should be interpreted relative to a vehicle equipped with the bi-directional sled for dredging system.

The term "configured" as used herein to describe a component, section or part of a device includes structure that is constructed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention as defined by the appended claims and their equivalents.

What is claimed is:

1. A bi-directional sled for a dredging system, comprising:

a support structure dimensioned and shaped to attach to a distal end of a hydraulic arm of an excavator; and a shroud assembly supported to the support structure for pivotal movement about an axis extending through the support structure between a first orientation and a second orientation, the shroud assembly having a shroud with a first edge and a second edge opposite the first edge such that (i) with the support structure moving the shroud assembly in a first direction relative to material to be dredged, friction between the shroud assembly and material to be dredged pivots the shroud into the first orientation with the first edge contacting the material to be dredged and (ii) with the support structure moving the shroud assembly in a second direction relative to material to be dredged, friction between the shroud assembly and the material to be dredged pivots the shroud into the second orientation with the second edge contacting the material to be dredged.

2. The bi-directional sled according to claim 1, wherein the support structure includes a slurry outlet, and the shroud is shaped such that with the shroud assembly moving the shroud directs material being dredged upward to the slurry outlet.

3. The bi-directional sled according to claim 2, wherein the support structure includes a plurality of classifier bars having an overall curved shape with the shroud of the shroud assembly being disposed beneath the classifier bars.

4. The bi-directional sled according to claim 3, wherein the slurry outlet has a first diameter, and each of the plurality of classifier bars are spaced apart from one another by a distance that is less than the first diameter.

5. The bi-directional sled according to claim 1, wherein the support structure includes a plurality of classifier bars having an overall curved shape with the shroud of the shroud assembly being disposed beneath the classifier bars.

6. The bi-directional sled according to claim 1, wherein the shroud assembly includes a pair of runners attached to opposite ends of the shroud, each of the pair of runners having a curvilinear shape.

7. The bi-directional sled according to claim 6, wherein the runners are dimensioned and shaped to contact material to be dredged such that friction between the runners and material to be dredged pivots the shroud assembly relative to the support structure to one of the first and second orientations.

8. The bi-directional sled according to claim 1, wherein the support structure includes a water spraying structure that is dimensioned and shaped to spray water on material being dredged.

9. The bi-directional sled according to claim 8, wherein the water spraying structure includes a first manifold fixed to a first side of the support structure and a second manifold fixed to a second side of the support structure.

10. The bi-directional sled according to claim 9, wherein the water spraying structure includes a valve installed between the first manifold and the second manifold, the valve being movable to a first position and a second position such that in the first position water is directed to the first manifold and in the second position water is directed to the second manifold.

11. The bi-directional sled according to claim 10, wherein the shroud assembly includes a pair of runners attached to opposite ends of the shroud, one of the pair of runners having valve contacting structure such that with the shroud assembly moved in the first direction relative to material to be dredged the valve is moved to the first position and with the shroud assembly moved in the second direction the valve is moved to the second position.

12. The bi-directional sled according to claim 11, wherein each of the pair of runners of the shroud assembly have a curvilinear shape.

13. The bi-directional sled according to claim 12, wherein the runners are dimensioned and shaped to contact material to be dredged such that friction between the runners and material to be dredged pivots the shroud assembly relative to the support structure to one of the first and second orientations.

14. The bi-directional sled according to claim 1, wherein the support structure includes an auger that rotates relative to the support structure.

15. The bi-directional sled according to claim 14, wherein the support structure includes a slurry outlet, and the augur is configured to break up the material being dredged such that the shroud assembly directs material being dredged upward to the slurry outlet.

16. The bi-directional sled according to claim 15, wherein the shroud of the shroud assembly is disposed beneath the auger.

17. The bi-directional sled according to claim 16, wherein the shroud assembly includes a pair of runners attached to opposite ends of the shroud, one of the pair of runners having valve contacting structure such that with the shroud assembly moved in the first direction relative to material to be dredged the valve is moved to a first position and with the shroud assembly moved in the second direction the valve is moved to a second position.

18. The bi-directional sled according to claim 1, wherein the shroud assembly includes at least one runner that pivots together with the shroud between the first orientation and the second orientation.

19. The bi-directional sled according to claim 1, wherein the shroud assembly is configured such that the first edge is a leading edge and the second edge is a trailing edge in the first orientation, the second edge is the leading edge and the first edge is the trailing edge in the second orientation, and the leading edge is located below the trailing edge in both the first orientation and the second orientation.

20. The bi-directional sled according to claim 1, wherein the friction between the shroud assembly and material to be dredged keeps the shroud assembly in the first orientation as the shroud assembly travels in the first direction, and the friction between the shroud assembly and the material to be dredged keeps the shroud assembly in the second orientation as the shroud assembly travels in the second direction.

* * * * *